United States Patent [19]

Burkhead et al.

[11] Patent Number: 4,707,155

[45] Date of Patent: Nov. 17, 1987

[54] RE-INKABLE RIBBON TRANSPORT SYSTEM

[75] Inventors: Herbert A. Burkhead; Ronald E. Hunt, both of Georgetown, Tex.

[73] Assignee: International Business Machines Corporation, Armonk, N.Y.

[21] Appl. No.: 813,163

[22] Filed: Dec. 24, 1985

[51] Int. Cl.[4] ..... B41J 27/12

[52] U.S. Cl. ..... 400/199; 400/196; 400/212; 400/214; 400/216.1; 400/240; 400/240.4; 400/248

[58] Field of Search ..... 400/120, 194, 195, 196, 400/196.1, 197, 198, 199, 200, 201, 202, 202.3, 207, 208, 208.1, 212, 214, 216, 216.1, 217, 240, 240.4, 248, 234, 697.1

[56] References Cited

U.S. PATENT DOCUMENTS

| | | | |
|---|---|---|---|
| 1,414,865 | 5/1922 | Delbare | 400/201 X |
| 1,826,568 | 10/1931 | Pelton | 400/199 |
| 2,486,175 | 10/1949 | Kittel | 400/234 X |
| 3,831,731 | 8/1974 | Mack et al. | 400/202 X |
| 3,904,017 | 9/1975 | Frechette | 400/208 X |
| 3,981,387 | 9/1976 | Gottschlich | 400/201 X |
| 3,995,731 | 12/1976 | Miller et al. | 400/195 |
| 4,084,682 | 4/1978 | Fairey et al. | 400/197 X |
| 4,203,677 | 5/1980 | Hatsell | 400/208 X |
| 4,264,224 | 4/1981 | Mathews | 400/208 X |
| 4,265,552 | 5/1981 | Bemis et al. | 400/208 X |
| 4,280,767 | 7/1981 | Heath | 400/217 X |
| 4,401,394 | 8/1983 | Hume et al. | 400/208 |
| 4,427,313 | 1/1984 | Giolitti | 400/697.1 X |
| 4,504,840 | 3/1985 | Evans et al. | 400/197 X |
| 4,526,487 | 7/1985 | Ikeda | 400/201 |
| 4,543,002 | 9/1985 | Bittner et al. | 400/216.1 X |

FOREIGN PATENT DOCUMENTS

| | | | |
|---|---|---|---|
| 0104772 | 6/1983 | Japan | 400/198 |
| 0078879 | 5/1984 | Japan | 400/196.1 |
| 0176085 | 10/1984 | Japan | 400/216.1 |

*Primary Examiner*—Ernest T. Wright, Jr.
*Attorney, Agent, or Firm*—Marilyn D. Smith

[57] ABSTRACT

An apparatus for supplying a newly re-coated continuous ribbon to a moving printhead carrier in a printer. The present invention is particularly adaptable for use in thermal printers having multicolored ribbons. The apparatus comprises a cartridge housing which is mounted on the printer frame, and which contains the ribbons. The newly re-coated ribbons exit the cartridge housing, become coupled to the moving printhead carrier, and then reenter the cartridge housing as used ribbon. The used ribbon passes a re-coating station where it is re-inked through contact with a donor ribbon and heated pressure rollers to become newly re-coated ribbon. A lift arm on the printhead carrier selects the desired colored ribbon which has been newly re-coated for printing.

10 Claims, 3 Drawing Figures

RE-INKABLE RIBBON TRANSPORT SYSTEM

BACKGROUND OF THE INVENTION

1. Field of the Invention

This invention relates to the field of ribbon printing devices, and more particularly to those devices that utilize multicolored ribbons with means for automatically re-coating the ribbon with ink during operation.

2. Background Art

In ribbon printing devices, the quality of the printing is greatly affected by the condition of the ribbon supply. The printing quality is improved with a ribbon that has not been used before. Ideally, one would use a ribbon once such that the ribbon would increment throughout the ribbon supply with each character that was printed. When the ribbon had incremented to the end of the supply, the ribbon would be discarded.

With this method, ribbon supplies are replaced frequently. For ease of use, ribbons are typically supplied in cartridges that are easily replaceable onto the printhead carrier of the printer. When the ribbon has been fed through the printhead once, the cartridge of used ribbon is discarded and replaced with a new cartridge supply of freshly inked ribbon.

Although it is convenient to replace a ribbon cartridge onto the print carrier, this ribbon cartridge adds excessive mass to the printhead carrier. This extra mass slows the response time and movement of the printhead carrier.

Additionally, the frequent replacement of ribbon cartridges has become somewhat costly. It is known that by extending the useful life of the ribbon, this expense can be reduced. One way to extend the useful life of a ribbon is to re-ink a continuous ribbon after each use. Such a device for replenishing marking fluid to a ribbon typically comprises a rotatable roll impregnated with a marking fluid such as ink.

A problem with common ink replenishing devices results from the non-constant feed rate of the ribbon through the printhead due to the different amounts of ribbon utilized during the printing and non printing modes of the printhead. Because of this, the replenishing device may supply ink to the ribbon in an uneven fashion. Consequently, the printing quality will become degraded as the printing varies in lightness and darkness with the varying amounts of ink on the ribbon.

SUMMARY OF THE INVENTION

It is therefore an object of this invention to lower the cost of ribbon supplies by extending the useful life of supply ribbons.

It is a further object of this invention to transfer various colored inks from a re-coating station to a portion of a multicolored ribbon to be fed to the moving printhead.

It is a further object of this invention to reduce the printhead carrier mass and size.

It is a further object of this invention to eliminate the need to re-ink at the same time and speed as the printer is printing.

It is a further object of this invention to automatically change ribbon colors for printing.

In a thermal color printer it is desirable to have automatic change of ribbon colors, an abundant ribbon supply, low cost ribbon supplies and a low carrier size and mass. The off carrier ink re-coating apparatus of this present invention fulfills these requirements by supplying low cost multicolored ribbon to the print element.

An off carrier ink re-coating apparatus for re-coating a ribbon with ink, transporting a queue supply of ribbon to and from the re-coating station, and coupling the ribbon supply to a print element on a moving carrier is disclosed and claimed for a printer. This apparatus is especially adaptable for thermal printers having a black ribbon and a multicolored ribbon. The apparatus of this invention comprises a continuous ribbon, a supply cartridge for housing the continuous ribbon, a re-coating station in contact with a portion of the ribbon, means for coupling the continuous ribbon from the supply cartridge to the moving printhead carrier, and means for buffering the quantity of ribbon between the re-coating station and the moving printhead carrier.

The continuous ribbon comprises two separate ribbons. One ribbon has black ink which is used frequently for ordinary text printing. The other ribbon is a multicolored ribbon having bands of various selected colored ink for special purpose printing.

The supply cartridge provides a housing for the two independent, continuous strips of re-coatable ribbon for a thermal type printer. The cartridge provides means for transporting these ribbons from a coating station to a translating printer carrier and back again. Additionally, there is a buffering means within the cartridge to maintain a constant tension on the ribbon even though the displacement of the ribbon passing through the re-coating station may not equal the displacement of the ribbon passing through the printer carrier. In this way, the ribbon does not need to be re-inked at the same rate and time as the print element is printing and incrementing ribbon through the print element.

The re-coating station comprises a donor ribbon and a plurality of pressure rollers. The donor ribbon contains bands of colored ink that correspond to the bands of color of the continuous supply ribbon. At the re-coating station, ink is transferred from a donor ribbon to the coatable ribbon strip by passing the two ribbons together through heated pressure rollers.

The main housing of the supply cartridge and the re-coating station are stationarily mounted on the printer frame and apart from the moving printhead carrier. By mounting both the re-coating station and the supply cartridge off of the printhead carrier, the mass and size of the printhead carrier is reduced. Coupling means for attaching the ribbon from a stationary cartridge to a moving printhead carrier provides a constant length ribbon path and allows a constant ribbon tension to be maintained between the cartridge housing and the moving printhead carrier.

At the printhead carrier in the illustrated embodiment, a stepper motor driven ribbon lift mechanism selects the ribbon's band of color to be used for printing. A thermal type print element transfers the ink from the ribbon to the paper. The used ribbon is then fed back to the re-coating station.

DESCRIPTION OF PREFERRED EMBODIMENT

Figure 1:
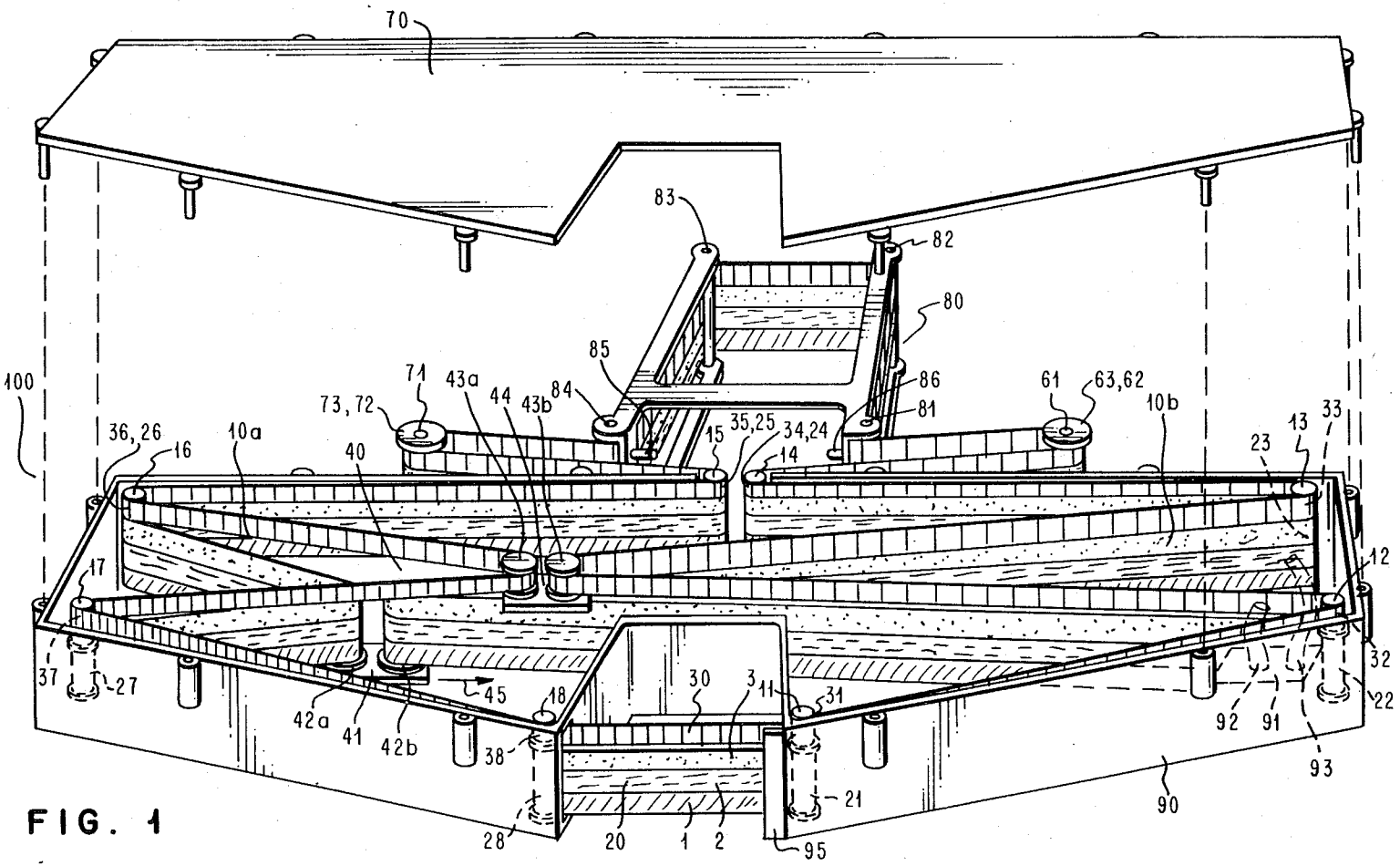
FIG. 1 is an exploded perspective view of a printer ribbon cartridge of this invention.

FIG. 1 shows the supply cartridge 100 with its cover 70 exploded from the main housing 90 to illustrate the internal embodiment of cartridge 100. The main housing 90 of cartridge 100 is structured to hold two independent, constant length, continuous strips of re-coatable base ribbon material 20 and 30. The cover 70 fastens to cartridge housing 90 to provide a protective container for the ribbons 30, 20.

These two vertically stacked ribbon strips 20, 30 provide a queue supply **10*b*, 10*a* of ribbon to and from a translating print element 210 (FIG. 3) for use in a printer, such as a thermal printer. The top ribbon strip 30 is coated with frequently used black ink, while the lower strip 20 is coated in rainbow fashion with bands 1, 2, 3, of different colors. Each band 1, 2, 3** has a width of a print line.

A plurality of posts 11, 12, 13, 14, 15, 16, 17, 18, are molded into the main housing 90. Both an upper and lower ribbon guide are rotatably mounted on each post. The upper ribbon guides 31, 32, 33, 34, 35, 36, 37, 38 guide the top ribbon strip 30, while the lower ribbon guides 21, 22, 23, 24, 25, 26, 27, 28 guide the lower ribbon strip 20 around each post 11, 12, 13, 14, 15, 16, 17, 18, respectively. Although the upper 31–38 and lower 21–28 ribbon guides are immediately above and below each other on the posts 11–18, each upper ribbon guide 31–38 rotates independently of its corresponding lower ribbon guide 21–28 on each post 11–18. This allows the two ribbons 30, 20 to be fed at different rates and times.

As described above, posts 11–18 are fixed positionally in reference to the cartridge main housing 90. However, there is a buffering means 40 within the cartridge 100 which is not fixedly attached to the main cartridge housing 90. This buffering means 40 comprises two upper ribbon guide rollers **43*a*, 43*b*; and two lower ribbon guide rollers 42*a*, 42*b***.

The two upper ribbon guide rollers **43*a*, 43*b* are rotatably connected to upper truck member 44, and are fixed in relation to each other with respect to the truck member 44. The two lower ribbon guide rollers 42*a*, 42*b* are rotatably connected to lower truck member 41, and also are fixed in relation to each other with respect to the truck member 41. Upper truck member 44 and lower truck member 41 are independently movable with respect to each other and with respect to the cartridge 100**.

For advancing the upper re-inked ribbon 30 from the re-coating station 300 (FIG. 3) to the printhead 210 (FIG. 3), the upper ribbon 30 is trained around upper guide rollers 31 and 32; upper guide roller **43*b*, which is coupled to floatable truck member 44; and then upper guide rollers 33 and 34. For advancing used ribbon from the printhead 210 (FIG. 3) to the re-coating station 300 (FIG. 3), the upper ribbon 30 is trained around upper guide rollers 35 and 36; upper guide roller 43*a*, which is also coupled to floatable truck member 44; and upper guide rollers 37 and 38**.

For advancing the lower re-inked ribbon 20 from the re-coating station 300 (FIG. 3) to the printhead 210 (FIG. 3), the lower ribbon 20 is trained around lower guide rollers 21 and 22; lower guide roller **42*b*, which is coupled to floatable truck member 41; and lower guide rollers 23 and 24. For advancing used ribbon 10*a* from the printhead 210 (FIG. 3) to the re-coating station 300 (FIG. 3), the lower ribbon 20 is trained around lower guide rollers 25 and 26; lower guide roller 42*a*, which is also coupled to floatable truck member 41; and lower guide rollers 27 and 28**.

A ribbon supply cartridge 100 wherein the ribbon 20, 30 is trained back and forth around guide rollers 21–28, 31–38 as described above, provides a long length path for the ribbon 20, 30. Thereby the product life of the re-inkable ribbon 20, 30 is increased by increasing the ribbon supply of a cartridge 100, increasing its useful life, and reducing the effective cost of the ribbon supply for a printer.

The buffering means 40 allows the upper ribbon 30 to be used at a different rate and independently of the lower ribbon 20. In this way, the upper ribbon 30, which in this example is the black ribbon, can be used the majority of the time for ordinary text printing without simultaneously incrementing the unused lower ribbon 20. Correspondingly, whenever the lower ribbon 20 is used, the upper ribbon 30 will not advance simultaneously. As a result, the buffering means 40 effectuates a buffered storage of used ribbon **10*a* and re-inked ribbon 10*b* whereby the need to re-ink at the same time and speed as the printer is printing is eliminated. This conserves ribbon 20, 30, extends the useful life of the ribbon 20, 30**, and reduces the effective cost of ribbon supplies for a printer.

Figure 3:
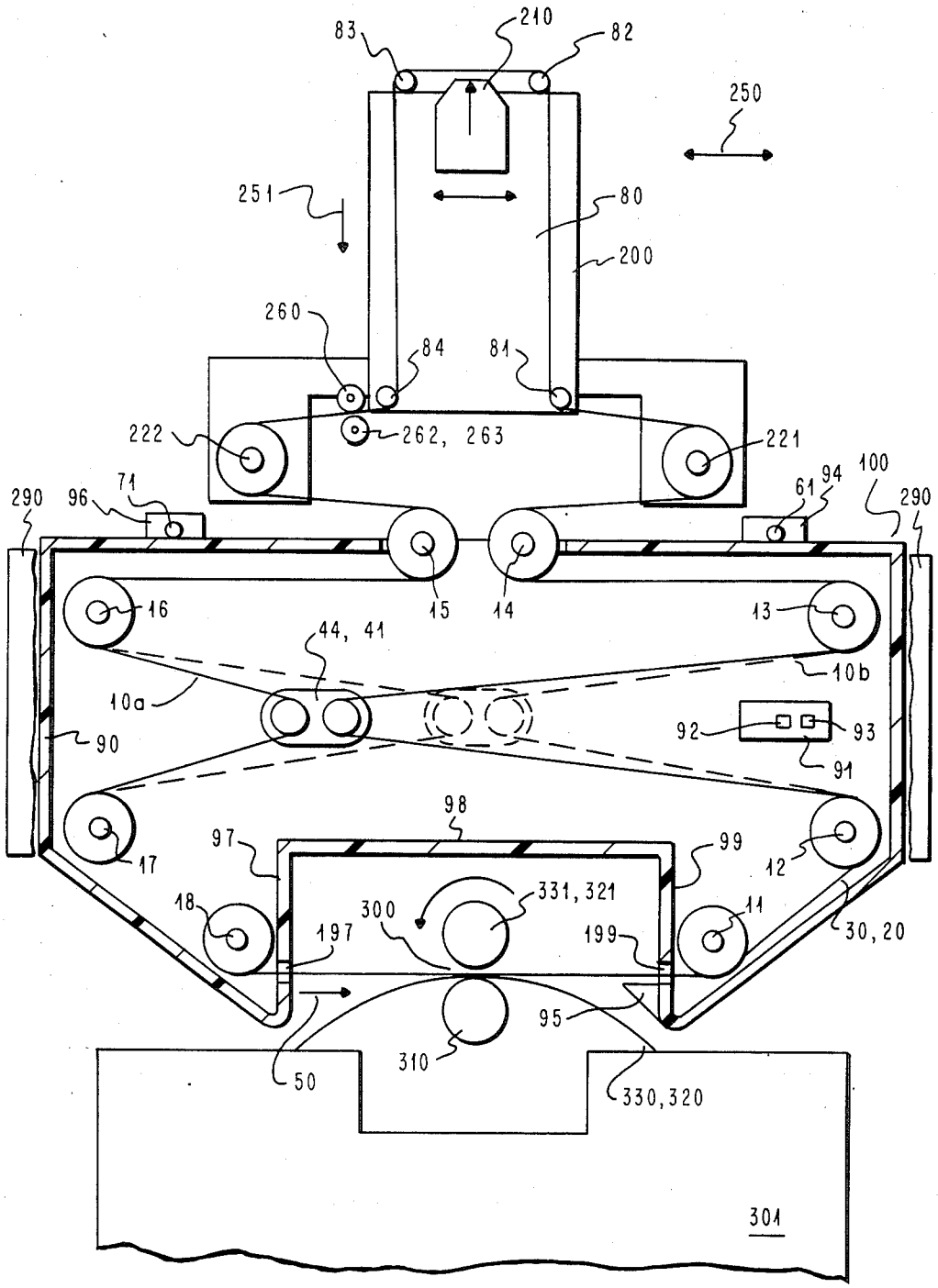
FIG. 3 is a simplified top plan view of FIG. 2 showing a ribbon cartridge interfaced with the translating print carrier and stationary re-coating station.

Additionally, this buffering means 40, eliminates the requirement that the ribbon 20, 30 in use be fed through the supply queue **10*a*, 10*b* at the same rate that the ribbon 20, 30 is fed past the moving printhead 210 (FIG. 3). With buffering means 40, the displacement of re-inked ribbon 20, 30 in supply queue 10*b* going from the re-coating station 300 to the printhead 210 does not have to equal the displacement of used ribbon 20, 30 in supply queue 10*a* returning from the printhead 210 to the re-coating station 300**.

Truck members 41 and 44 of buffering means 40 float independently of each other across the queue supply **10*a*, 10*b* of ribbon 20, 30 to compensate for the varying length of ribbon 20, 30 in each supply queue 10*a*, 10*b*. As the path length of ribbon 20, 30 in queue supply 10*b* going from the re-coating station 300 (FIG. 3) to the printhead 210 (FIG. 3) decreases, the path length of ribbon 20, 30 in queue supply 10*a* going from the printhead 210 (FIG. 3) to the re-coating station 300 (FIG. 3) increases accordingly as truck member 41 or 44 moves in the direction of the arrow 45 in FIG. 1**.

Upon ribbon switch 93 and lower ribbon switch 92 are mounted below the cartridge 100 and extend into the cartridge housing 90 through opening 91 in the base of cartridge housing 90. These upper and lower switches 92, 92 detect the extreme right-hand position of the ribbon truck members 44 and 41, respectively. The function of the switches 93, 92 is to detect a low quantity of available ribbon 20, 30 in supply queue **10*b*, and initiate a command to start the operation of the re-coating station 300. As the re-coating station 300 starts, the supply queue 10*b* of "new" or re-inked ribbon 20, 30 will increase, and the ribbon truck members 44, 41 will move towards the left as viewed in FIG. 1. Similarly, there may also be additional switches 93, 92 to detect the extreme left-hand position of ribbon truck members 44 and 41, respectively. The function of the switches 93, 92 on the left would be to detect a high quantity of re-coated ribbon 20, 30, in supply queue 10*b* and to initiate a command to halt the operation of the re-coating station 300**.

As further shown in FIG. 1, the ribbon 20, 30 exits the cartridge housing 90 around guide rollers 24, 34 on post 14; and reenters the cartridge housing 90 around guide rollers 25, 35 on post 15.

To facilitate the packaging and loading of the ribbon supply of the present invention, vertical posts 61, 71 are attached with the cartridge housing 90 in any conventional manner such as by being molded to tabs 94, 96 FIG. 3, extending from the cartridge housing 90. On these vertical posts 61, 71 are removable upper guide rollers 63, 73, respectively, for guiding the upper ribbon 30. Also on these vertical posts 61, 71 are removable lower guide rollers 62, 72 to guide the lower ribbon 20. Vertical posts 61, 71 serve as a temporary holding fixture for the guide rollers 62, 63, 72, 73 until the cartridge 100 is loaded into a printer for use. At that time, the upper and lower guide rollers 63, 73, 62, 72 are removed from posts 61, 71 and placed correspondingly on posts 221, 222 (FIG. 2) of the print element carrier 200, which is part of the printer.

From the guide rollers 63, 62, on post 61, the ribbon 30, 20 continues around to a ribbon lift arm 80. Ribbon lift arm 80 is an integral part of the ribbon cartridge 100 through its coupling with ribbon 30, 20, although it is physically detached from the cartridge housing 90.

Each corner 81, 82, 83, 84 of ribbon lift arm 80 guides upper ribbon 30 and lower ribbon 20 past a thermal print element 210 (FIG. 3). Printing takes place on the ribbon 30, 20 between corners 82 and 83.

Figure 2:
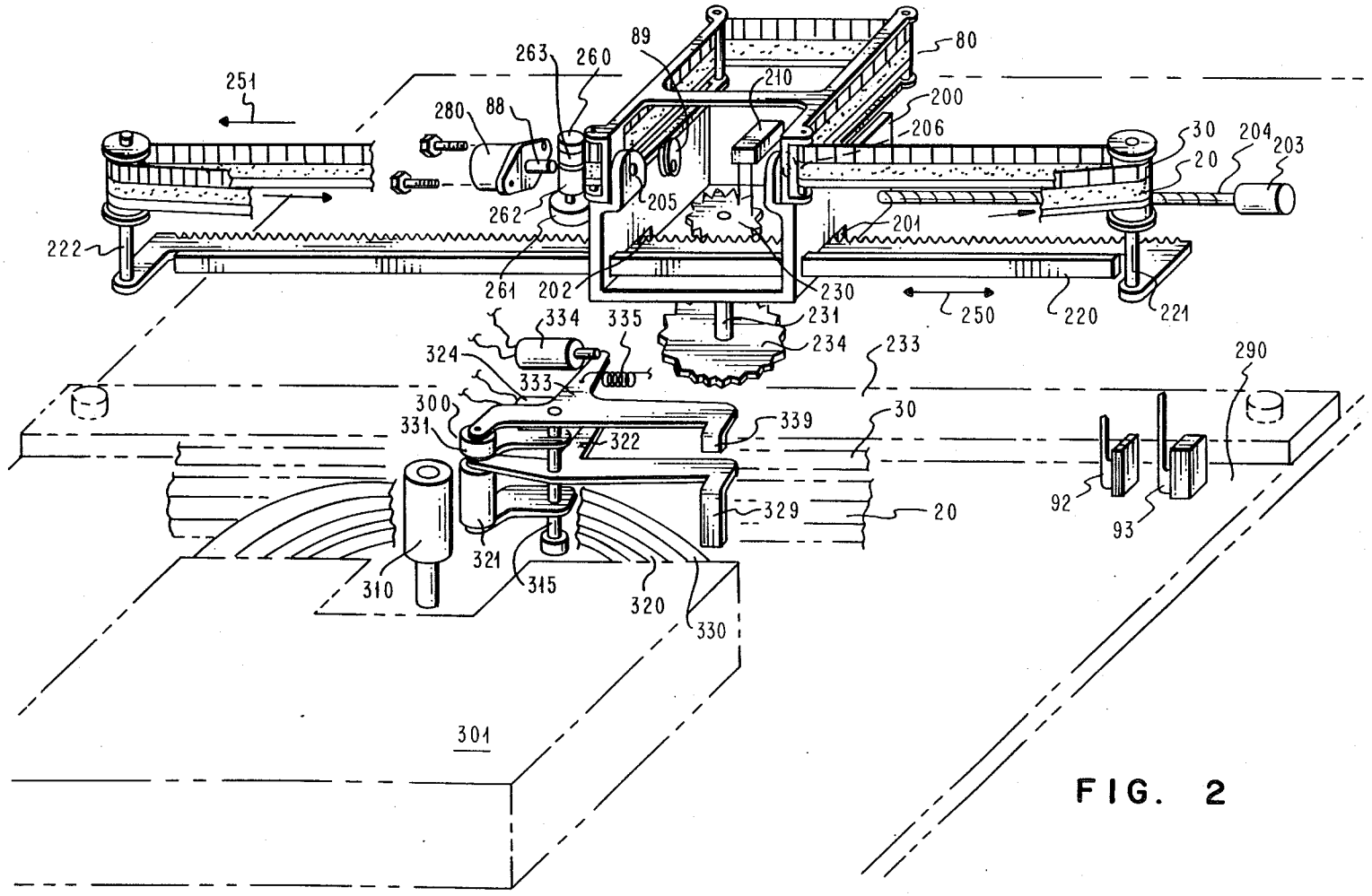
FIG. 2 is a perspective view of a translating printhead carrier and a stationary ink re-coating station.

The ribbon lift arm 80 as shown in FIG. 1 is placed on the print element carrier 200 as shown in FIG. 2. The rest of the cartridge housing 90 is not shown in FIG. 2 for clarity of the other details. However, the rest of the cartridge housing 90 is loaded onto the printer frame 290 such that the ribbon lift arm 80 snaps onto the print element carrier 200, and the other end of the cartridge housing 90 associates with the re-coating station 300 as shown in FIG. 3.

The ribbon lift arm 80 as shown broken away from the cartridge 100 in FIG. 2 cooperates with print element carrier 200 when cartridge 100 is loaded for operation into a printer. Mounting holes 205, 206 (FIG. 2) in carrier 200 receive pivot pins 85, 86 (FIG. 1), respectively, of lift arm 80. In this way, upper lift arm 80 pivots relative to carrier 200 about pivot pins 85, 86 in mounting holes 205, 206.

As shown in FIG. 2, the means for pivoting the lift arm 80 relative to the carrier 200 comprises a cam 89 fastened to shaft 88 on stepper motor 280 which is mounted on carrier 200. Motor 280 rotates lift cam 89 which contacts and lifts the underside of ribbon lift arm 80 to select the ribbon color to be lifted to print element 210.

As shown in FIG. 3, an aperture is formed by cartridge side walls 97, 98, 99. This aperture is structured to receive the re-coating station 300. Located in wall 97 is an aperture 197 through which "used" ribbon 30, 20 from the supply queue 10*a* is pulled in direction of arrow 50 to the re-coating station 300. After passing the re-coating 300, the ribbon 20, 30 reenters the cartridge 100 through aperture 199 in wall 99 as "new" ribbon 30, 20 in supply queue 10*b*.

The ink re-coating station 300 is best shown in FIG. 2. The re-coating station 300 comprises a heated platen roller 310. Bellcranks 333, 322 pivot freely about shaft 315 which is fixed to a printer frame 290. Pinch rollers 331, 321 are rotatably connected to bellcranks 333, 322, respectively. Rollers 331, 321 are individually and selectively moved into contact with platen 310. As roller 331 is selectively moved into contact with platen 310, the upper ribbon 30 is pressed into contact with an upper donor ribbon 330. Supply ribbon 20, 30 and donor ribbon 330, 320 of the re-coating station 300 is shown as broken in FIG. 2 for clarity in showing the re-coating station 300.

A solenoid 334, 324 may be used to selectively move bellcranks 333, 322 and rollers 331, 321, respectively. Rollers 331, 321 are restored to position away from the heated platen roller 310 by return springs such as the one shown for roller 331 and numbered 335 in FIG. 2. The corresponding return spring for the roller 321 is hidden and therefore not shown. The return springs are attached to the Bellcranks 333, 322 at one end, and to the frame of the printer at the other end.

Also shown in FIG. 2 are brake tabs 339 and 329 which are part of bellcranks 333 and 322, respectively. As rollers 331, 321 are individually and selectively moved into contact with platen 310 to re-ink the corresponding ribbon 30, 20, the brake tabs 339, 329 pivot away from the ribbon 20, 30. This allows the ribbon 20, 30 to be moved through the re-coating station 300. As rollers 331, 321 retrack from the platen 310 after re-coating is complete, brake tabs 339, 329 pivot towards brake pad 95 (FIG. 3) on housing 90. Pinching the ribbon 30, 20 between brake tab 339, 329 and brake pad 95 prevents the ribbon 20, 30 from advancing past the re-coating station 300 while the ribbon 20, 30 is not being re-coated.

Preferably, brake pad 95 is a molded projection from housing 90. A high friction material is used on the contacting surfaces of the ribbon brake tabs 339, 329 and the brake pad 95 to grasp the ribbon 20, 30.

Reference is now made to carrier 200 in FIG. 2. To maintain a constant length ribbon path to the carrier 200, rack 220 is meshed to gear 230. Carrier 200 is translatable in directions shown by arrow 250. Gear rack 220 has vertical shafts 221, 222 fixedly attached to each end of gear rack 220. Gear rack 220 is slidingly restrained in bearing slots 201, 202 of carrier 200. Gear 230 meshes with sliding gear rack 220, and is fixedly attached to shaft 231. Shaft 231 rotates freely in carrier 200. Also fixedly attached to shaft 231 is gear 234 which is in mesh with stationary gear rack 233. Therefore, when carrier 200 translates in the directions of arrow 250, stationary rack 233 rotates gear 234, shaft 231, and gear 230. Preferably, gear 234 has twice the number of teeth as gear 230. As a result, the gear rack 220 is translated at one half of the velocity and displacement of carrier 200. This provides a constant length ribbon path and allows a constant ribbon tension to be maintained.

DESCRIPTION OF OPERATION

As shown in FIG. 3, during actual operation, cartridge 100 is inserted into an accepting printer containing print element carrier 200 and ink re-coating station 300 as shown in FIG. 3.

Cartridge housing 90 is attached to a printer frame 290 while the lift arm 80 of cartridge 100 is snapped into position onto the carrier 200. The ribbon 30, 20 from the cartridge 100 is inserted between rollers 331, 321 and platen 310 of re-coating station 300.

When cartridge 100 is installed, ribbons 20 and 30 are positioned between ribbon drive roller 260 and pinch rollers 262, 263 on carrier 200. During operation, as seen in FIG. 3, the ribbon 20 or 30 is pinched between its corresponding pinch roller 262 or 263 and drive roller 260 thereby advancing the ribbon 20, 30 past the print element 210.

Additionally, when cartridge 100 is installed, ribbons 20 and 30 are positioned between heated platen 310 and rollers 321, 331 on re-coating station 300, respectively. Likewise, when the donor cartridge 301 is installed, donor ribbons 320 and 330 are also positioned between heated platen 310 and pinch rollers 321 and 331, respectively.

As shown in FIG. 2, during operation, stepper motor 280 rotates cam 89 to raise lift arm 80 to position either ribbon 30 or a desired color of ribbon 20 in front of print element 210. Then carrier 200 is escaped in directions of arrow 250 in FIG. 2 by conventional means shown by a motor 203, and lead screw 204. As shown in FIG. 3, as printing occurs from print element 210, the ribbon 20 or 30 is escaped in direction of arrow 251 by drive roller 260 (FIG. 3) driven by conventional means such as a motor 261. Ribbon brake 339, 329 holds the ribbon 30 or 20 at the re-coating station 300 so as ribbon is fed, the corresponding truck member 41 or 44 is pulled to the right, as shown by the dotted lines in FIG. 3. Thereby newly re-inked ribbon is supplied to the carrier 200. When truck member 41 or 44 reaches and actuates the corresponding switch 92 or 93, the corresponding solenoid 334 or 324 (FIG. 2) is picked, and the heated platen roller 310 begins rotation. The picked solenoid 334 or 324 rotates the corresponding bellcranks 333 or 322 such that the corresponding roller 331 or 321 presses the corresponding ribbon 30 or 20 into contact with the corresponding donor ribbon 330 or 320 and the heated platen 310. The rotation of the bellcrank 333, 322 (FIG. 2) releases the ribbon brake 339, 329 (FIG. 3).

When ribbon 30 or 20 and the corresponding donor ribbon 330 or 320 are pressed together and fed in direction of arrow 50 in FIG. 3 through the heated pressure platen 310 and corresponding pinch roller 331 or 321, the ink from donor ribbon 330, 320 is transferred to ribbon 30, 20. The corresponding ribbon truck 44 or 41 is pulled to the left supplying "used" ribbon 20, 30 in supply queue 10*a* from the print element 210 to the re-coating station 300. At the same time, newly re-inked ribbon 20, 30 is stored in the right side of cartridge housing 90 in supply queue 10*b*.

The present invention has been particularly described and shown. It will be understood by those skilled in the art that other changes in form may be made without departing from the spirit and scope of this invention. Those changes may include, but are not limited to, the following examples.

Although this invention has been described in accordance with a black ribbon and a multicolored ribbon, the invention may be adaptable for a single ribbon or more than two ribbons. Accordingly, the invention was described with the black ribbon on top of the multicolored ribbon. It would be obvious that these may be interchanged.

We claim:

1. A ribbon transport apparatus for use in a printer having a printhead attached to a translatable printhead carrier comprising:

a continuous translatable re-coatable ribbon;

means for containing said continuous translatable re-coatable ribbon, wherein said means for containing is detached from said translatable printhead carrier, and stationary with respect to a printer frame;

a gear rack coupling between said printhead carrier and said printer frame for effectuating a constant length ribbon path between said printhead carrier and said containing means;

a re-coating station positionally detached from said translatable printhead carrier, and in contactable relation with said continuous translatable re-coatable ribbon;

a first supply queue of re-inked ribbon from the re-coating station;

a second supply queue of used ribbon from the printhead carrier; and buffering means coupled to said first and second supply queue for movement effectuating a decrease in a first ribbon path length of one of said supply queues and a corresponding increase in a second ribbon path length of the other of said supply queues;

wherein a displacement of the continuous translatable re-coatable ribbon passing the re-coating station varies from a displacement of the continuous translatable re-coatable ribbon passing the printhead.

2. A ribbon transport apparatus for use in a printer having a printhead attached to a translatable printhead carrier comprising:

a plurality of continuous translatable re-coatable ribbons;

means for containing said continuous translatable re-coatable ribbons, wherein said means for containing is detached from said translatable printhead carrier, and stationary with respect to a printer frame;

a gear rack coupling between said printhead carrier and said printer frame for effectuating a constant length ribbon path between said printhead carrier and said containing means;

a re-coating station positionally detached from said translatable printhead carrier, and in contactable relation with said continuous translatable re-coatable ribbons;

a first supply queue of a plurality of re-inked ribbons from the re-coating station;

a second supply queue of a plurality of used ribbons from the printhead carrier; and buffering means coupled to said first and second supply queue for movement effectuating a decrease in a first ribbon path length of one of said supply queues and a corresponding increase in a second ribbon path length of the other of said supply queues;

wherein a displacement of the plurality of continuous translatable re-coatable ribbons passing the re-coating station varies from a displacement of the plurality of continuous translatable re-coatable ribbons passing the printhead.

3. A ribbon transport apparatus for use in a printer having a printhead attached to a translatable printhead carrier comprising:

a plurality of continuous translatable re-coatable ribbons, wherein each of said plurality of continuous translatable re-coatable ribbons are selectable for printing;

means for containing said continuous translatable re-coatable ribbons;

a re-coating station in contactable relation with said continuous ribbons;

a first supply queue of a plurality of re-inked ribbons from the re-coating station;

a second supply queue of a plurality of used ribbon from the printhead carrier; and buffering means for each one of said plurality of continuous translatable re-coatable ribbons, each of said buffering means coupled to said first and second supply queue for movement effectuating a decrease in a first ribbon path length of one of said supply queues and a corresponding increase in a second ribbon path length of the other of said supply queues for each of said plurality of continuous translatable re-coatable ribbons;

wherein a displacement of said selected continuous translatable re-coatable ribbon for printing passing the re-coating station varies from a displacement of said selected continuous translatable re-coatable ribbon passing the printhead.

4. A ribbon transport apparatus as in claim 3 wherein only said continuous translatable recoatable ribbon selected for printing is advancable through said re-coating station.

5. The ribbon transport apparatus of claim 3 wherein each of said buffering means are independently movable with respect to each other of said buffering means to effectuate independent incrementing of each of said plurality of continuous translatable re-coatable ribbons.

6. A ribbon cartridge for use in a printer having a translatable printhead carrier comprising:

a housing for containing a plurality of continuous translatable ribbons;

a first supply queue in said housing of said plurality of continuous translatable ribbons advanceable to the printhead carrier;

a second supply queue in said housing of said plurality of continuous translatable ribbons advanceable from the printhead carrier; and buffering means for each of said plurality of continuous translatable ribbons in said containing means, each of said buffering means coupled to said first supply queue and said second supply queue for movement effectuating a decrease in a first ribbon path length of one of said supply queues, and a corresponding increase in a second ribbon path length of the other of said supply queue for each of said plurality of continuous translatable ribbons.

7. A ribbon cartridge as in claim 6 further comprising a lift arm coupled to said plurality of continuous translatable ribbons, and detached from said housing.

8. A ribbon transport apparatus for use in a printer having a printhead attached to a translatable printhead carrier comprising:

a continuous translatable re-coatable ribbon;

means for containing said continuous translatable re-coatable ribbon;

a first supply queue in said containing means of said continuous translatable re-coatable ribbon advanceable to the printhead carrier;

a second supply queue in said containing means of said continuous translatable re-coatable ribbon advanceable from the printhead carrier; and buffering means coupled to said first and said second supply queue for movement effectuating a decrease in a first ribbon path length of one of said supply queues and a corresponding increase in a second ribbon path length of the other of said supply queues.

9. A ribbon transport apparatus for use in a printer having a printhead attached to a translatable printhead carrier comprising:

a plurality of continuous translatable re-coatable ribbons;

means for containing said continuous translatable re-coatable ribbons;

a recoating station in contactable relation with said continuous translatable re-coatable ribbons;

a first supply queue in said containing means of said continuous translatable re-coatable ribbons re-inked from the recoating station;

a second supply queue in said containing means of said continuous translatable re-coatable ribbons used from the printhead carrier; and buffering means coupled to said first and second supply queue for movement effectuating a decrease in a first ribbon path length of one of said supply queues and a corresponding increase in a second ribbon path length of the other of said supply queues;

wherein a displacement of the plurality of continuous translatable re-coatable ribbons passing the re-coating station varies from a displacement of the plurality of continuous translatable re-coatable ribbons passing the printhead.

10. A ribbon cartridge for use in a printer having a translatable printhead carrier comprising:

a housing for containing a continuous translatable ribbon;

a first supply queue for said continuous translatable ribbon advanceable to the printhead carrier;

a second supply queue of said continuous translatable ribbon advanceable from the printhead carrier; and buffering means in said containing means coupled to said first supply queue and said second supply queue for movement effectuating a decrease in a first ribbon path length of one of said supply queues, and a corresponding increase in a second ribbon path length of the other of said supply queues.

* * * * *

UNITED STATES PATENT AND TRADEMARK OFFICE

CERTIFICATE OF CORRECTION

PATENT NO. : 4,707,155

DATED : November 17, 1987

INVENTOR(S) : H. A. Burkhead et al

It is certified that error appears in the above-identified patent and that said Letters Patent is hereby corrected as shown below:

Column 4, line 49: "Upon" should read --Upper--.

Column 10, line 43: "for" should read --of--.

Signed and Sealed this

Nineteenth Day of December, 1989

*Attest:*

JEFFREY M. SAMUELS

*Attesting Officer* *Acting Commissioner of Patents and Trademarks*